US006321832B1

(12) United States Patent
Le

(10) Patent No.: US 6,321,832 B1
(45) Date of Patent: Nov. 27, 2001

(54) RADIATOR WITH INTEGRATED LIQUID-AIR HYBRID OIL COOLER

(75) Inventor: Anh Le, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/780,159

(22) Filed: Feb. 9, 2001

(51) Int. Cl.[7] ..... F28F 7/10

(52) U.S. Cl. ..... 165/140; 165/150; 165/DIG. 916; 123/41.33

(58) Field of Search ..... 165/140, DIG. 916, 165/150, 148, 153; 29/890.052; 123/41.33, 196 AB

(56) References Cited

U.S. PATENT DOCUMENTS 3,253,651 * 5/1966 Larson ..... 165/140
3,447,596 * 6/1969 Hughes ..... 165/140
5,009,262 * 4/1991 Halstead et al. ..... 165/140
5,186,242 * 2/1993 Adachi et al. ..... 165/140
5,366,005 * 11/1994 Kadle ..... 165/916
5,645,125 7/1997 Kroetsch et al. ..... 165/137
6,179,049 * 1/2001 Higgins ..... 165/148
6,196,304 * 3/2001 Schwarz ..... 165/140

* cited by examiner

*Primary Examiner*—Ira S. Lazarus
*Assistant Examiner*—Terrell McKinnon
(74) *Attorney, Agent, or Firm*—Patrick M. Griffin

(57) ABSTRACT

An automotive radiator has an integrated air-liquid cooled oil cooler incorporated directly into the radiator core and header tanks. A pair of nested oil cooler tubes, nested in a general U shape, has parallel upper and lower lengths running through the top and bottom of the basic core, spaced within the same header plates as the standard coolant tubes. Intermediate parallel lengths of the oil cooler tubes run through the center lengthwise of one longer header tank. A shorter header tank allows the upper and lower lengths of the oil cooler tubes to run through its header plate with clearance from its tank ends.

4 Claims, 3 Drawing Sheets

RADIATOR WITH INTEGRATED LIQUID-AIR HYBRID OIL COOLER

TECHNICAL FIELD

This invention relates to vehicle engine and oil cooling systems in general, and specifically to a radiator with hybrid air and liquid oil cooler integrally incorporated into radiator tanks and core structure.

BACKGROUND OF THE INVENTION

Vehicles with often incorporate a transmission fluid or engine oil cooler mounted in the liquid coolant outlet tank of the engine cooling radiator as a convenient means to cool those fluids. Typically, the radiator consists of a basic core with header tanks on each side, and flattened metal coolant flow tubes, generally aluminum, extending between the tanks. Each tank is a plastic box open on one side, the open side being clinched to a metal header plate that receives the ends of the radiator flow tubes and keeps them regularly spaced apart. As shown in co assigned U.S. Pat. No. 5,645,125, a conventional oil cooler consists of a series of plates stacked into a general box shape, which is installed inside the radiator outlet tank, with sealed inlet and outlet pipes running through the radiator tank wall. This requires very careful sealing not only of the many joints between the oil cooler plates, but also of the metal to plastic interface between the cooler pipes and radiator tank wall. That interface requires mechanical sealing, such as threaded fittings and compressible O rings, which is not as robust as a brazed joint of the type found between the ends of the radiator flow tubes and the radiator tank header plate. Such an oil cooler is also quite massive and heavy, and blocks a good deal of flow area within the radiator tank.

A relatively newer proposed oil cooler construction is incorporated within all metal (aluminum) header tanks of an all metal core. In effect, the tank and the header plate are one and the same part, or at least formed of the same material. An example may be seen in co assigned U.S. Pat. No. 5,823,250. There, the header tank itself has an extruded body, with integral slotted header plate and integral internal oil cooler passage. End caps are brazed on the seal the ends of the header tanks and the internal oil cooler passage simultaneously. This type of integral oil cooler construction depends on the header tank being made as an extrusion, which is not always practical, because of weight and cost considerations, and most radiator tank constructions still consist of a plastic tank clinched with a gasket seal to a metal core header plate.

An alternate type of oil cooler is a simple air-oil cooler, in which a small, separate core, similar in design to a small radiator of all metal construction, has pressurized oil pumped through its interior and ambient air forced over its finned exterior. Such a separate heat exchanger for the oil (ortransmission fluid) is an obvious extra expense, and requires its own space to be mounted to the vehicle, typically in the engine compartment. Such "real estate" on the vehicle is becoming increasingly rare and expensive. It would be a cost and space advantage to somehow to utilize only the space occupied by the existing radiator and, if possible, at least some of the existing components of the radiator. While the known in tank type of oil cooler does so, to an extent, it still constitutes a heavy and expensive solution.

In tank oil coolers of differing construction are known, at least in the published patent art. Co assigned U.S. Pat. No. 5,366,005 discloses a radiator with spaced header tanks, within one of which a helical round oil cooler tube is arrayed. One end of the helical, round cross sectioned tube exits the radiator header tank wall to act as an oil inlet, to which it is sealed in an unspecified manner. The other end of the helical tube serves as an outlet into a sealed, separate oil chamber formed at the bottom of either a radiator header tank or, in an alternate embodiment, at the bottom of a condenser header tank. From the oil chamber, oil enters a plurality of flow tubes, similar to the coolant or refrigerant flow tubes in the main body of the radiator or condenser, and running parallel thereto. These separate tubes allow the air that is forced through the condenser and/or radiator to further cool the oil subsequent to the initial cooling received in the liquid cooling it first receives in the radiator header tank The dedicated oil cooler tubes empty into yet another sealed and separate oil outlet chamber in the opposite header tank. Such separate oil inlet and outlet chambers at the bottom of the radiator header tanks would represent a serious departure from the typical radiator header tank construction, especially in the case of the more typical plastic radiator tank, and would be very difficult to seal. Such sealing would be critical, however, as the oil would absolutely have to be rigorously sealed from the radiator coolant.

While it would be very difficult to create a suitable seal for such dedicated oil inlet and outlet chambers in the header tank, the manufacture of the conventional, slotted header plate, and the subsequent leak tight brazing of the radiator coolant flow tubes to the header plate slots, is a well understood and well controlled process. The flattened metal flow tubes, typically extruded or fabricated aluminum, are inserted through closely matching slots formed through the header plates. The surrounding interface between the two has a well controlled gap width. Braze material provided on the surface of either the flat metal tube or the header plate is melted when the core itself is brazed, and drawn into the tube end-slot interface to form a simple, consistent and leak proof joint. If similar materials and techniques alone could be used to form both the liquid and air cooled parts of an integrated oil cooler, such a design might find practical application.

SUMMARY OF THE INVENTION

The invention provides an air/liquid oil cooler that is incorporated into a radiator of substantially standard construction, and which relies on no more than standard header plate to flow tube construction methods to maintain a rigorous seal of the oil cooler, both an internal seal relative to the liquid coolant, and an external seal relative to the ambient.

In the preferred embodiment disclosed, a radiator of basically standard construction includes header tanks formed of regularly slotted metal header plates clinched to plastic tank bodies. The ends of metal coolant flow tubes, with standard air cooling fins stacked between the tubes, are brazed leak tight into and through the header plate slots. The only significant differences from standard radiator construction are quantitative, not qualitative or material. One difference is that one header tank body, preferably the coolant inlet tank, is shorter than the other, but its header plate is standard length, thereby leaving an "extra" unobstructed length of header plate above and below its shorter tank body. Even the shorter inlet tank would be manufactured, clinched and sealed by standard methods, however. The outlet tank has a standard length tank body and header plate. Another quantitative difference is that one or two of the standard complement of radiator coolant tubes are eliminated at the top and bottom of the core, leaving an equal number of header plate tube slots empty at the top and bottom of both header plates.

The otherwise unoccupied header plate tube slots accommodate an integrated oil cooler made according to the invention. At least one continuous length of metal oil cooler tube, extruded or otherwise fabricated so as to be capable of withstanding standard oil temperature and pressures, is bent generally into a large U shape, with an upper and lower length slightly longer than the tank to tank width of the radiator, and an intermediate length comparable the length of the coolant outlet tank's interior. After the coolant flow tubes are in place between the header plates, the upper and lower lengths of the oil cooler tube are inserted through the empty tube slots of both header plates, The oil cooler tube is thereby supported with the upper and lower lengths running parallel to the radiator coolant tubes, at the top and bottom of the radiator core and past the installed location of the top and bottom ends of the inlet header tank. The intermediate run of the oil cooler tube or tubes is supported parallel to the inside of the outlet tank header tank plate. Standard air cooling fins are stacked between all of the tubes, and also between the upper and lower lengths of the oil cooler tube and the coolant tubes adjacent thereto. This basic metal core can then be brazed as part of the single braze process. Finally, the plastic tanks, both the standard length outlet tank and shorter inlet tank, are clinched to their respective header plates.

The final result is an oil cooler consisting of a length of continuous, leak free tube, with two lengths exposed to radiator air flow, and an intermediate length exposed to the liquid coolant flow in the cooler outlet tank. The oil cooler thus formed has no possible internal leak points into the tank, and its potential leak points out of the coolant tank are sealed with equal rigor to the coolant flow tubes themselves. The upper and lower lengths of the oil cooler tube are solidly supported by the opposed header plate slots, and by the fins to which they are brazed. The oil cooler so formed is very lightweight and compact, and does not interfere with coolant flow inside the outlet tank to a significant degree.

BRIEF DESCRIPTION OF THE DRAWINGS

These and other features of the invention will appear from the following written description, and from the drawings, in which.

DESCRIPTION OF THE PREFERRED EMBODIMENT

Figure 1:
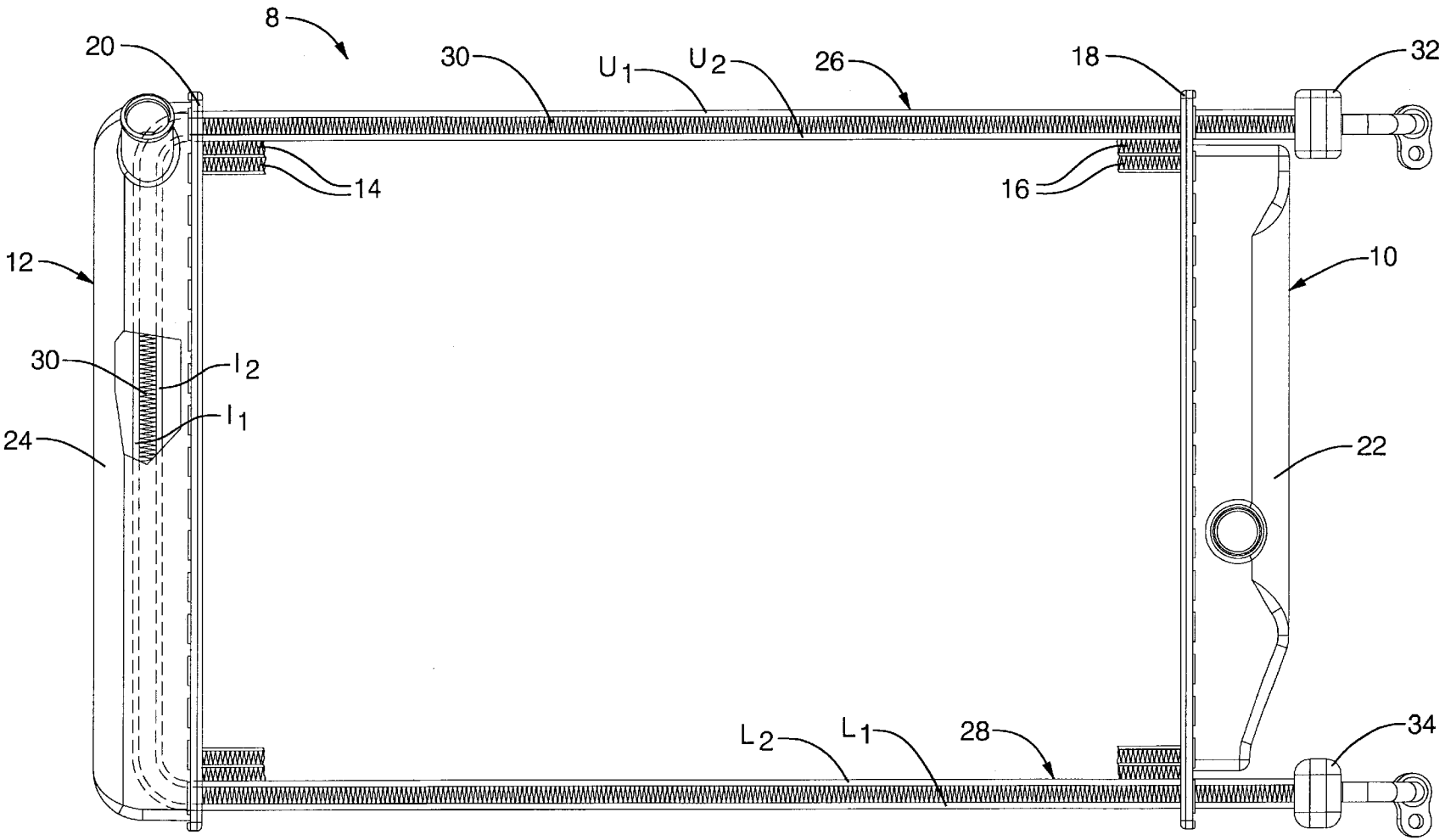
FIG. 1 is a face on view of a preferred embodiment of the invention.

Referring first to FIG. 1, several basically standard radiator components provide the basic framework of the combined air/liquid oil cooler of the invention, indicated generally at 8. These include a pair of header tanks, an inlet header tank, indicated generally at 10, an outlet header tank, indicated generally at 12, and an intermediate core between the tanks 10 and 12 comprised of a regularly spaced plurality of parallel coolant flow tubes 14, with intermediate corrugated air cooling fins 16. Forced air from a conventional, non illustrated fan is blown across the tubes 14 and fins 16 to cool engine coolant flowing therethrough. The coolant tubes 14, being relatively low pressure, are typically formed as a fabricated shell of stamped aluminum or the like, weld seamed along one edge. They could also be formed as a seamless, extruded shell. The air cooling fins 16 are generally thin aluminum stock, only as thick as necessary to withstand the braze process without deforming. One or the other of the outer surfaces of the tubes 14 and fins 16 are coated with a meltable braze material. When the tubes 14 are fabricated, rather than extruded, then it is generally the outer surface of the tubes 14 that are so coated, or "clad" as it is generally called. The other major metal component of the core are a pair of slotted header plates, a header plate 18 for the inlet header tank 10 and a header plate 20 for the outlet tank 12, with opposed inner surfaces between which the coolant tubes 14 extend, generally perpendicular thereto. The plates 18 and 20 are identical, but numbered differently simply for ease of distinction. Each header plate 18 and 20 is a generally rectangular piece of stamped aluminum, which may be braze coated on its outer surface, and which is regularly slotted so as to accommodate an end of each flow tube 14 with a close clearance. Since they do not withstand high pressure, the coolant tubes 14 can be relatively thin and malleable, and the ends thereof can be expanded to anchor them to the plates 18 and 20. The close tube-slot clearance allows melted braze material from the surfaces surrounding each interface to be pulled into the interface by capillary action within the braze oven, later hardening to form rigid, leak proof seams. All of the components described to this point, and their method of manufacture and assembly, are typical of conventional radiator cores.

Figure 2:
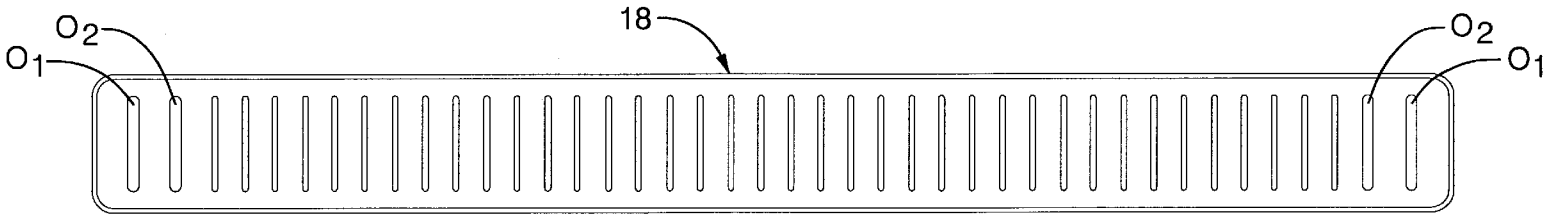
FIG. 2 is a plan view of a pair of disassembled header plates.

Referring next to FIGS. 1 and 2, a few differences from conventional radiator construction are evident. The core itself has two fewer coolant tubes 14 at the top and bottom of the core than usual, creating two pairs of adjacent extra or "free" slots at the top and bottom of both identical header plates 18 and 20 indicated at O1 and O2. Only plate 18 is illustrated in FIG. 2. As is typical, each header plate 18 and 20 is, after the core is brazed, clinch sealed to the perimeter edge of a respective plastic tank body 22 and 24 to complete the respective header tank 12 and 14. Normally, the tank bodies 22 and 24 are identical. Here, however, the inlet header tank's plastic tank body 22 is somewhat shorter than the other 24, and shorter than its header plate 18, enough shorter so as to leave the two pairs of "free" slots O1 and O2 in its header plate 18 uncovered. The outlet header tank's tank body 24 is conventional length, covering all of the slots in its header plate 20. The purpose for these minor deviations from standard construction is to accommodate the structure that provides the novel air/liquid oil cooler according to the invention, described in detail next.

Figure 3:
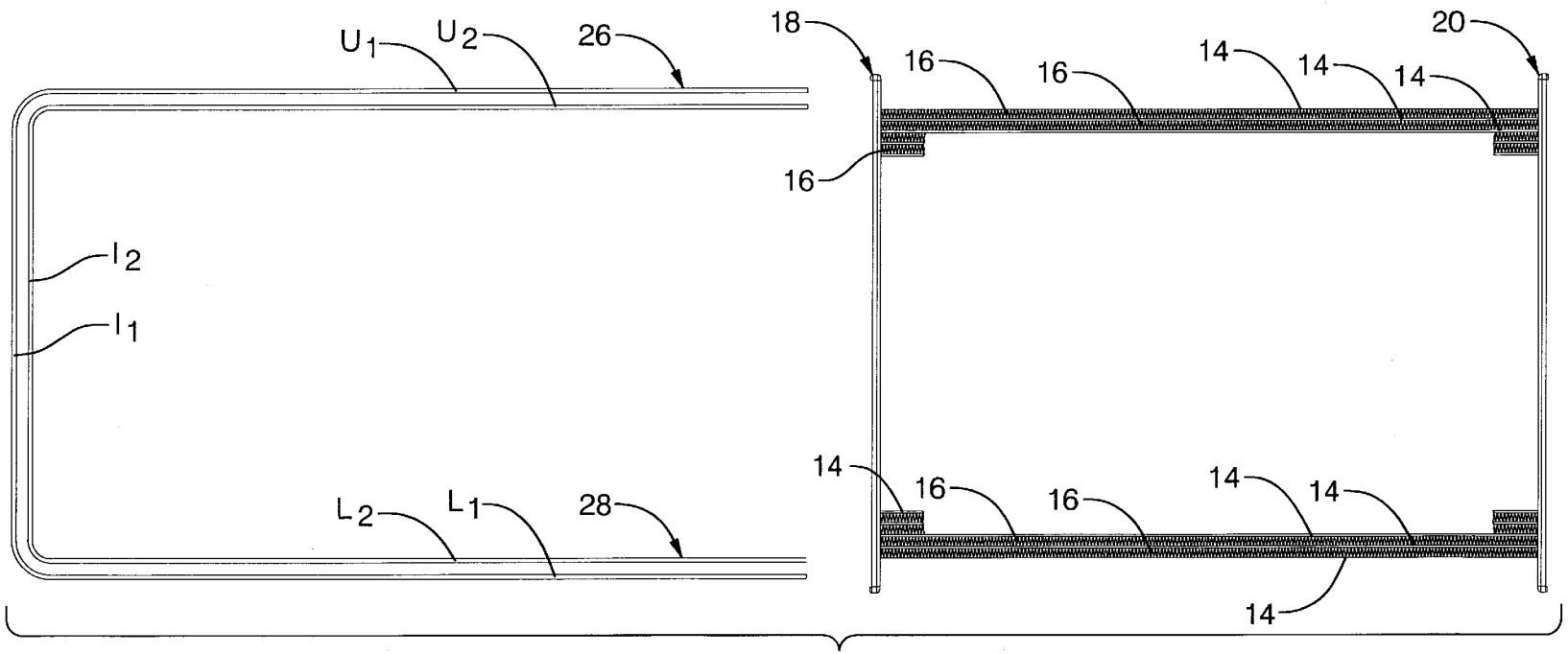
FIG. 3 is a view showing the basic radiator core before the addition of the two oil cooler tubes.

Referring next to FIGS. 2 and 3, a pair of extruded aluminum tubes 26 and 28 is manufactured with a width and thickness comparable to the coolant flow tubes 14, but would be internally reinforced with the kind of strengthening webs typically found in condenser tubes. Each tube 26 and 28 is substantially longer, however, with a length sufficient to allow it to be bent into a general squared off U shape, with an upper length U1 and U2 respectively, a lower length L1 and L2 respectively, and an intermediate length I1 and I2 respectively. One oil tube, 26, is slightly longer than the other oil tube 28, as well, so that the two can be nested, after bending, one within the other, parallel at all points and co terminating at their free ends. The upper and lower lengths U1, U2 and L1, L2 of both oil cooler tubes 26 and 28 are longer than the length of the coolant flow tubes 14, while the intermediate lengths I1, I2 of both oil cooler tubes 26 and 28 are, in general, short enough to fit within the interior of the outlet header tank 12. More specifically, the intermediate length I1 of outer tube 26 is equivalent to the spacing of the slot pair O1 of the header plates 18 and 20, and the intermediate length I2 of the inner tube 28 matches the spacing of the slot pair O2. The oil cooler tubes 26 and 28 may, since they are extruded, high pressure tubes, be made slightly thicker than coolant flow tubes 14, in which case their supporting header plate slots O1 and O2 would be made correspondingly thicker.

Figure 4:
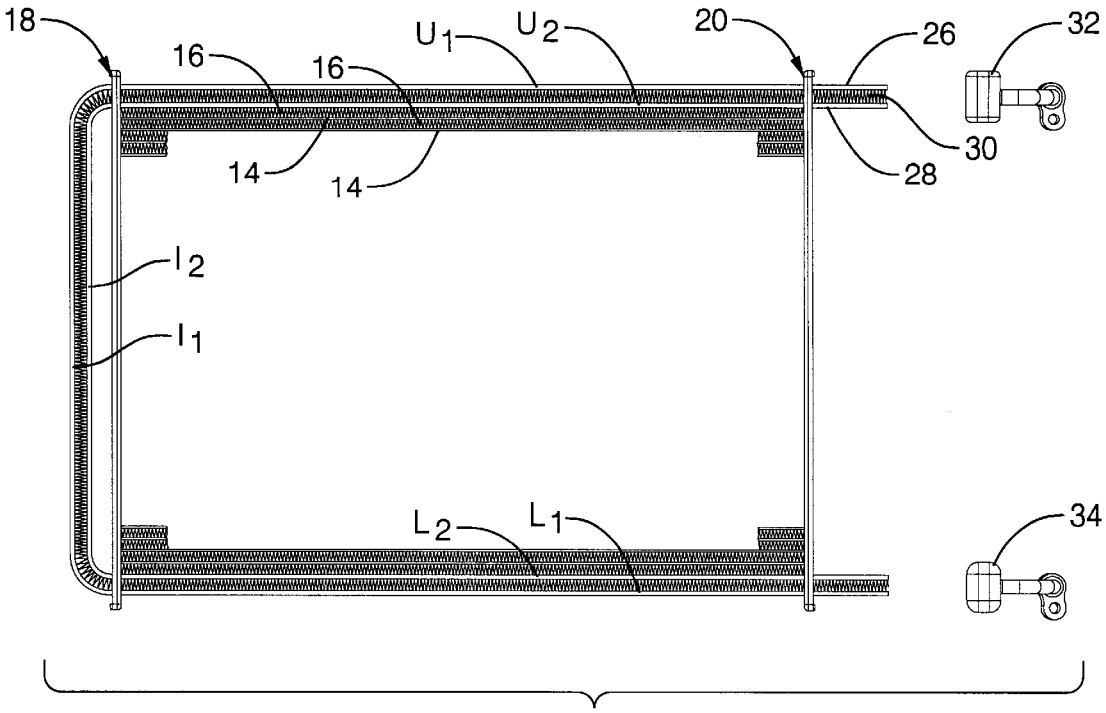
FIG. 4 is a view of the core completed but for the addition of the oil inlet and outlet.

Referring next to FIG. 4, the relative dimensions described above allow the bent oil cooler tubes 26 and 28 to be inserted through the slot pairs O1 and O2 respectively, as shown, prior to brazing, with all corresponding lengths thereof supported in nested, parallel fashion. The two upper tube lengths U1 and U2, and the two lower tube lengths L1 and L2 are supported parallel to one another and to the adjacent engine coolant tubes 14 by the slot pairs O1 and O2. The intermediate oil cooler tube lengths I1 and I2 are similarly supported parallel and close to the outside of the outlet tank header plate 20, in an orientation that ultimately locates them centrally within the outlet header tank 12, as described further below. Basically, the nested oil tubes 26 and 28 receive the same orientation and support from the header plates 18 and 20 as do the coolant tubes 14. When the air cooling fins 16 are stacked between the regularly spaced coolant tubes 14, comparable air cooling fins 30 are stacked between adjacent, parallel lengths of the oil cooler tubes 26 and 28. Therefore, the basic radiator core as described above, of coolant tubes 14, fins 16, and header plates 18 and 20, as well as the oil cooler tubes 26 and 28, form a single unit that can be brazed as described above, in a single step. The interfaces between the oil cooler tubes 26 and 28 and the header plates 18 and 20 will be sealed just as well as the interfaces with the conventional coolant flow tubes 14.

Figure 5:
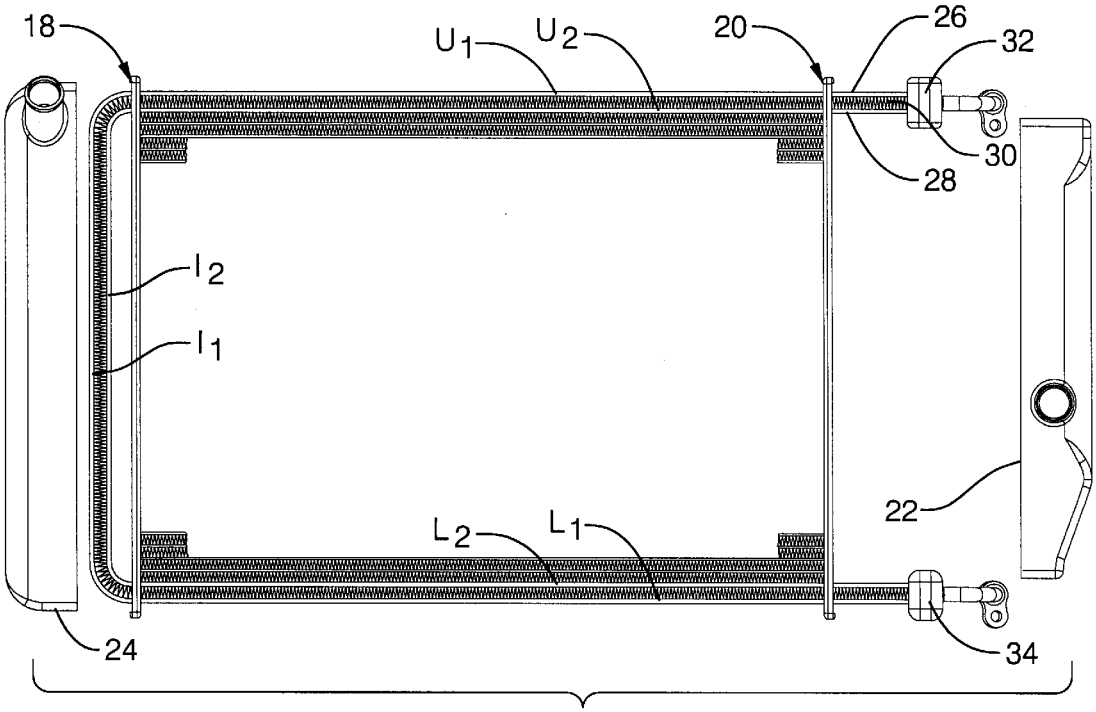
FIG. 5 is a view of the invention completed but for the addition of the tank bodies.

Referring next to FIG. 5, after the basic metal core described above has been manufactured, an oil inlet and outlet fitting 32 and 34 respectively may be welded to the coterminating ends of the pair of oil cooler tubes 26 and 28. Or, the fittings 32 and 34 could be attached as part of the basic braze process described above. The radiator 8 is completed by clinch sealing the shorter tank body 22 to header plate 18, and the standard length tank body 24 to the opposed header plate 20. This seals the shorter tank body 22 around the ends of all of the coolant flow tubes 14, and seals the longer tank body 24 also around the ends of all of the coolant flow tubes 14 and around the intermediate lengths I1 and I2 of the oil cooler tubes 26 and 28. There is no external coolant leak path out of the outlet header tank 12 past the oil cooler tubes 26 and 28, because of the braze seam seal. There is no internal leak path from the oil cooler tubes 26 and 28 into the outlet header tank 12, because of the fact that the intermediate lengths I1 and I2 thereof are seamless and unitary. There is no leak path internally or externally relative to the inlet header tank 10 for the simple reason that the oil cooler tubes 26 and 28 do not pass through it at any point. The slot pairs O1 and O2 in the inlet header tank header plate 18 provide only physical support to the ends of the oil cooler tubes 26 and 28, not sealing, since the shorter tank body 22 does not cover them.

Referring again to FIG. 1, the operation of the completed unit 8 is as follows. Engine coolant enters the inlet header tank 10, and is pumped across all of the coolant flow tubes more or less evenly and into the outlet header tank 12. It is cooled in the process by forced air blown over the coolant flow tubes 14 and air cooling fins 16. Reduced temperature engine coolant enters the outlet header tank 12, and is pumped back to the engine. Concurrently, hot oil from the engine or transmission is pumped into inlet 32 through the oil cooler tube upper lengths U1 and U2, toward the outlet header tank 12. The hot oil cooler tubes 26 and 28 do not touch the ends of the plastic tank body 22. In this first, upper pass, the oil is cooled by the same air flow that serves the engine coolant in the coolant flow tubes 14. At the outlet tank header plate 20, the oil path turns and runs through the two parallel intermediate lengths I1 and I2, which, together with the fin 30, form a liquid cooled oil cooler pass. This intra tank portion of the hybrid cooler is much lighter and simpler than typical, multi plate oil coolers. The oil cooler tube lengths I1 and I2, being "stretched out" almost full length within the tank 12, better utilize the available volume, allowing the tank body 24 to be lower profile and slimmer. There is no localized "choke point" blocking the internal volume of the tank 12, as with a conventional, wider oil cooler, so there is less interference with the flow of liquid coolant through the tank 12. As it flows up through tank 12, coolant also flows between the lengths I1 and I2 and through the intermediate fin 30, over essentially the entire inner length of outlet header tank 12, thoroughly cooling the already air cooled oil flowing therethrough. Fin 30, where it resides between the tube intermediate lengths I1 and I2, does not serve as an air cooling fin, of course, but still works regardless of the cooling medium that is circulating over it. Finally, oil exits the outlet header tank 12 into the lower lengths L1 and L2, and is further cooled on its return trip to the outlet fitting 34. An additional, structural, advantage of the invention is that the more rigid oil cooler tubes 26 and 28, by bordering the thinner coolant tubes 14 above and below, act to protect the coolant tubes 14, eliminating the separate support brackets generally used for that purpose.

Variations in the embodiment disclosed could be made. The design lends itself very well to an all aluminum design, both structurally and in terms of processing, as the tank bodies 22 and 34 could be made of brazable aluminum alloy and attached to the plates 18 and 20 as part of the basic braze operation. As few as one, or more than two oil cooler tubes, could be used, but it is unlikely that more than two would be needed. An advantage to using at least two is that a space is created for the corrugated fin 30 within the tank 12, between the tube intermediate lengths I1 and I2. Therefore, it will be understood that it is not intended to limit the invention to just the embodiment disclosed.

What is claimed is:

1. An automotive radiator with integrated liquid-air oil cooler, comprising, a pair of spaced, regularly slotted header plates, a plurality of air cooled, engine coolant tubes extending between said header plates, generally perpendicular thereto, the ends of which are located in all but at least the lowermost and uppermost slot in each header plate and sealed liquid tight to said header plates, a continuous oil cooler tube bent into a general U shape having an upper length extending through each uppermost slot in each header plate and parallel to a coolant tube, an intermediate length extending generally parallel to one header plate, and a lower length extending through each lowermost slot in each header plate and parallel to a coolant tube, said oil cooler tube being sealed liquid tight to at least said one header plate, a first tank body sealed liquid tight to said one header plate and sufficiently long to cover all of the slots therein as well as the intermediate length of said oil cooler tube, a second tank body sealed liquid tight to the other of said header plates and sufficiently long to only cover all but at least the uppermost and lowermost slot therein, so as to form, with said header plates, a pair of spaced header tanks to feed engine coolant into and out of said engine coolant tubes, and, fittings on the ends of said oil cooler tube upper and lower lengths to feed oil into and out of said oil cooler tube, whereby, oil running through said oil cooler tube will be air cooled in the upper and lower lengths thereof, as well as liquid cooled in the intermediate length thereof located within said first header tank, with no internal leak path from said oil cooler tube within said first header tank.

2. An automotive radiator with integrated liquid-air oil cooler according to claim 1, further characterized in that the ends of said engine coolant tubes are located in all but two uppermost and two lowermost header plate slots, and a pair of generally U shaped, nested oil cooler tubes extend through said two uppermost and two lowermost header plate slots, with a corrugated cooling fin located between said two nested oil cooler tubes.

3. An automotive radiator with integrated liquid-oil cooler according to claim 2, further characterized in that a corrugated cooling fin 30 is incorporated between parallel intermediate lengths of said two nested oil cooler tubes.

4. An automotive radiator with integrated liquid-oil cooler according to claim 1, further characterized in that said first and second tank body and said header plates are all brazable aluminum alloy.

* * * * *